US009658586B1

(12) United States Patent
Sone

(10) Patent No.: US 9,658,586 B1
(45) Date of Patent: May 23, 2017

(54) IMAGE FORMING APPARATUS WITH HEAT EQUALIZATION OF A FIXING BELT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshihiro Sone, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/983,972

(22) Filed: Dec. 30, 2015

(51) Int. Cl.
*G03G 15/20* (2006.01)

(52) U.S. Cl.
CPC ..... *G03G 15/206* (2013.01); *G03G 15/2057* (2013.01); *G03G 2215/2035* (2013.01)

(58) Field of Classification Search
CPC ..... G03G 5/14; G03G 15/22; G03G 15/2092; G03G 15/2053; G03G 15/206; G03G 15/2064; G03G 15/2017; G03G 15/2057; G03G 15/2089; G03G 2215/2035; G03G 2215/2041
USPC ..... 399/329; 219/216
See application file for complete search history.

(56) References Cited

U.S. PATENT DOCUMENTS 7,998,572 B2 * 8/2011 McGilvray ..... F16C 33/12 428/323
2003/0029853 A1 * 2/2003 Izawa ..... G03G 15/2053 219/216
2011/0135358 A1 * 6/2011 Kikuchi ..... G03G 15/2064 399/329

* cited by examiner

*Primary Examiner* — Robert Beatty
(74) *Attorney, Agent, or Firm* — Amin, Turocy & Watson LLP

(57) ABSTRACT

In accordance with an embodiment, an image forming apparatus comprises a fixing apparatus which fixes a toner image formed on an image receiving medium. The fixing apparatus comprises an endless belt, a roller facing the belt, and a nip pad which faces the roller across the belt and presses the belt together with the roller. A coating layer is formed on a surface of the nip pad which faces the belt. The coating layer is constituted by a simple substance or a compound having at least one kind of elements selected from a group 6 element and a group 14 element.

9 Claims, 3 Drawing Sheets

IMAGE FORMING APPARATUS WITH HEAT EQUALIZATION OF A FIXING BELT

FIELD

Embodiments described herein relate generally to an image forming apparatus.

BACKGROUND

Conventionally, there is an image forming apparatus such as a multi-function peripheral (hereinafter referred to as an "MFP"), a printer and the like. The image forming apparatus is provided with a fixing apparatus. The fixing apparatus comprises an endless belt (fixing belt) which heats and fuses toner images, a roller (press roller) facing the belt, and a nip pad which faces the press roller across the belt and pressurizes the fixing belt together with the press roller. The fixing belt has a heat-generation function. A nip section is formed by contacting the fixing belt with the press roller. An image receiving medium (hereinafter referred to as "sheet") on which there is a toner image passes through the nip section, and thus the toner image is fixed on the sheet.

The nip pad contacts the fixing belt. Thus, the nip pad and the fixing belt are abraded due to friction. In order to reduce the abrasion, a sheet-like friction reducing member is arranged between the nip pad and the fixing belt.

Further, there is an area sheets pass through and an area no sheet passes through in the fixing belt according to the sheet size. Hereinafter, the area the sheets pass through is referred to as "paper-passing area" and the area no sheet passes through is referred to as "non-paper passing area". Further, a sheet having a width of A4 R-sized sheet or a sheet having a width smaller than the width of A4 R-sized sheet is defined as a small-sized sheet.

In a case in which the small-sized sheets are continuously passed, the heat generated in the paper-passing area of the fixing belt is taken by the sheet at the time of fixing an image. If heat-generation operation is continued to balance the paper-passing area where the heat is taken away, the temperature rises excessively in the non-paper passing area where the heat is not taken away. Thus, it is required to carry out a heat equalization operation of which the heat in the non-paper passing area is moved to the paper-passing area. However, the friction reducing member between the nip pad and the fixing belt on the sheet will hinder the heat equalization of the fixing belt.

DETAILED DESCRIPTION

Figure 1:
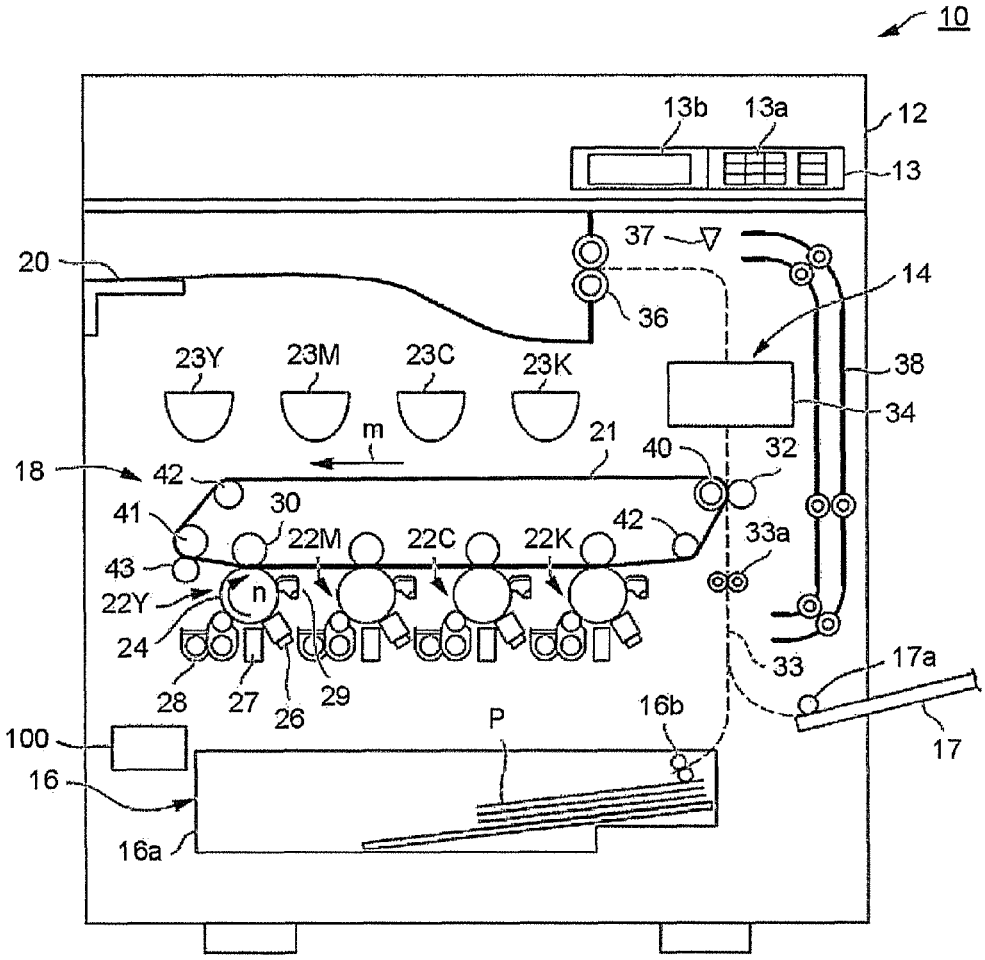
FIG. 1 is a side view illustrating an image forming apparatus including a fixing apparatus according to an embodiment.

In accordance with an embodiment, an image forming apparatus comprises a fixing apparatus configured to fix a toner image formed on an image receiving medium. The fixing apparatus comprises an endless belt, a roller facing the belt, and a nip pad configured to face the roller across the belt and pressurizes the belt together with the roller. A coating layer is formed on a surface of the nip pad which faces the belt. The coating layer is constituted by a simple substance or compound having at least one kind of elements selected from a group 6 element and a group 14 element.

Herein, an image forming apparatus according to the embodiment is described with reference to the accompanying drawings. Further, same components are applied with same reference numerals in the drawings.

FIG. 1 is a side view illustrating an image forming apparatus according to the embodiment. Hereinafter, an MFP 10 is exemplified and described as an example of the image forming apparatus.

As shown in FIG. 1, the MFP 10 includes a scanner 12, a control panel 13 and a main body section 14. Each of the scanner 12, the control panel 13 and the main body section 14 has a control section thereof. The MFP 10 includes a system control section 100 serving as a control section which collectively controls each control section. The system control section 100 includes a CPU (Central Processing Unit) 100*a*, a ROM (Read Only Memory) 100*b* and a RAM (Random Access Memory) 100*c* (refer to FIG. 4).

The system control section 100 controls a main body control circuit 101 (refer to FIG. 2) serving as the control section of the main body section 14. The main body control circuit 101 includes a CPU, a ROM and a RAM (none is shown). The main body section 14 includes a sheet feed cassette section 16, a printer section 18, a fixing apparatus 34 and the like. The main body control circuit 101 controls the sheet feed cassette section 16, the printer section 18, the fixing apparatus 34 and the like.

The scanner 12 reads an original image. The control panel 13 is equipped with input keys 13*a* and a display section 13*b*. For example, the input key 13*a* receives input operations by a user. For example, the display section 13*b*, which is a touch panel type, receives input operations by the user and displays information for the user.

The sheet feed cassette section 16 is provided with a sheet feed cassette 16*a* and a pickup roller 16*b*. The sheet feed cassette 16*a* stores a sheet P serving as an image receiving medium. The pickup roller 16*b* picks up the sheet P from the sheet feed cassette 16*a*.

The sheet feed cassette 16*a* feeds unused sheets P. A sheet feed tray 17 feeds an unused sheet P through a pickup roller 17*a*.

The printer section 18 forms an image. For example, the printer section 18 carries out an image formation operation of the original image read by the scanner 12. The printer section 18 is provided with an intermediate transfer belt 21. The printer section 18 supports the intermediate transfer belt 21 with a back-up roller 40, a driven roller 41 and a tension roller 42. The back-up roller 40 has a driving section (not shown). The printer section 18 rotates the intermediate transfer belt 21 in a direction indicated by an arrow m.

The printer section 18 is equipped with four image forming stations 22Y, 22M, 22C and 22K. The image forming stations 22Y, 22M, 22C and 22K are used to form yellow (Y), magenta (M), cyan (C) and black (K) images respectively. The image forming stations 22Y, 22M, 22C and 22K are arranged in parallel along the rotation direction of the intermediate transfer belt 21 below the intermediate transfer belt 21.

The printer section 18 is equipped with cartridges 23Y, 23M, 23C and 23K above the image forming stations 22Y, 22M, 22C and 22K respectively. The cartridges 23Y, 23M, 23C and 23K store yellow (Y), magenta (M), cyan (C) and black (K) toner for replenishment respectively.

Among the image forming stations 22Y, 22M, 22C and 22K, the image forming station 22Y for forming yellow (Y) images is exemplified and described below. Further, the image forming stations 22M, 22C and 22K have constitutions identical to the constitution of the image forming station 22Y, and therefore the detailed description thereof is not provided.

The image forming station 22Y is provided with a charger 26, an exposure scanning head 27, a developing device 28 and a photoconductor cleaner 29. The charger 26, the exposure scanning head 27, the developing device 28 and a photoconductor cleaner 29 are arranged around a photoconductive drum 24 which rotates in a direction indicated by an arrow n.

The image forming station 22Y includes a primary transfer roller 30. The primary transfer roller 30 faces the photoconductive drum 24 across the intermediate transfer belt 21.

After the photoconductive drum 24 is charged by the charger 26, the image forming station 22Y exposes the photoconductive drum 24 with the exposure scanning head 27. The image forming station 22Y forms an electrostatic latent image on the photoconductive drum 24. The developing device 28 develops the electrostatic latent image on the photoconductive drum 24 using a two-component developing agent including toner and carrier.

The primary transfer roller 30 primarily transfers the toner image formed on the photoconductive drum 24 to the intermediate transfer belt 21. The image forming stations 22Y, 22M, 22C and 22K form a color toner image on the intermediate transfer belt 21 through the primary transfer roller 30. The color toner image is formed by overlapping a yellow (Y) toner image, a magenta (M) toner image, a cyan (C) toner image and a black (K) toner image sequentially. The photoconductor cleaner 29 removes the toner remained on the photoconductive drum 24 after primary transfer.

The printer section 18 includes a secondary transfer roller 32. The secondary transfer roller 32 faces the back-up roller 40 across the intermediate transfer belt 21. The secondary transfer roller 32 secondarily transfers the color toner image on the intermediate transfer belt 21 to the sheet P collectively. The sheet P is fed from the sheet feed cassette section 16 or the manual sheet feed tray 17 along a conveyance path 33.

The printer section 18 is provided with a belt cleaner 43 which faces the driven roller 41 across the intermediate transfer belt 21. The belt cleaner 43 removes the toner remained on the intermediate transfer belt 21 after the secondary transfer.

The printer section 18 includes a register roller 33*a*, the fixing apparatus 34 and a sheet discharge roller 36 along the conveyance path 33. The printer section 18 includes a branching section 37 and a reversal conveyance section 38 at the downstream side of the fixing apparatus 34. The branching section 37 sends the sheet P subjected to fixing processing to a sheet discharge section 20 or the reversal conveyance section 38. In a case of duplex printing, the reversal conveyance section 38 reverses the sheet P sent from the branching section 37 to the direction of the register roller 33*a* to convey it. The MFP 10 forms the fixed toner image on the sheet P with the printer section 18, and then discharges it to the sheet discharge section 20.

Further, the MFP 10 is not limited to the tandem developing system, and the number of the developing device 28 is also not limited. Further, the MFP 10 may transfer the toner image directly from the photoconductive drum 24 to the sheet P.

Hereinafter, the fixing apparatus 34 is described in detail.

Figure 2:
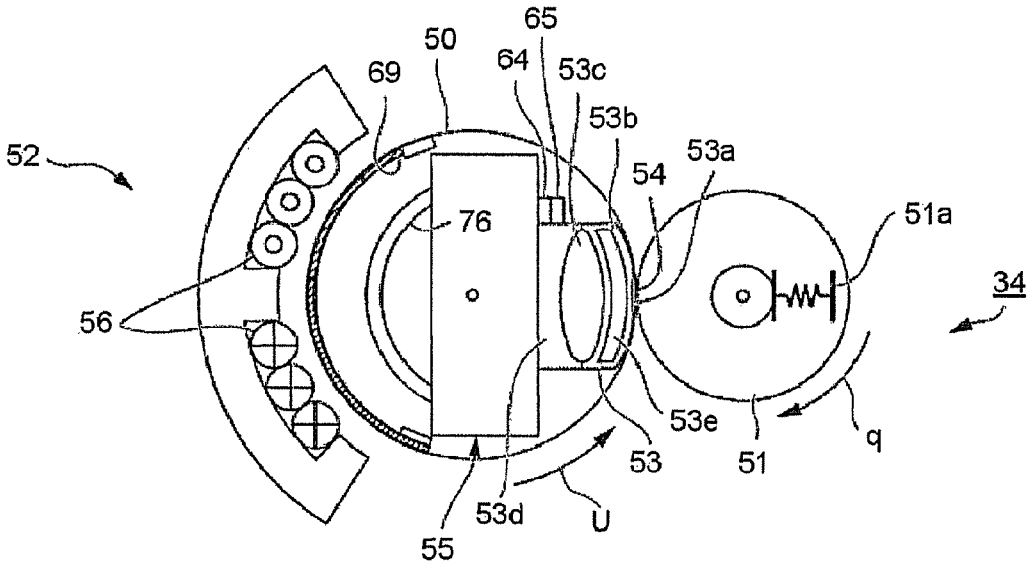
FIG. 2 is a side view illustrating the fixing apparatus according to the embodiment.
Figure 3:
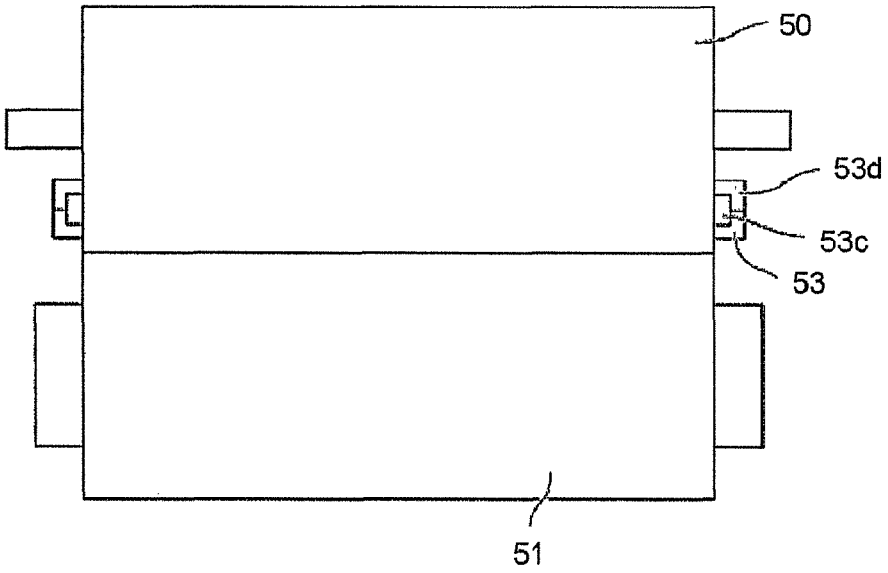
FIG. 3 is a plan view illustrating the fixing apparatus according to the embodiment.

FIG. 2 is a side view illustrating the fixing apparatus 34 including an electromagnetic induction heating coil unit 52 according to the embodiment. FIG. 3 is a plan view illustrating the fixing apparatus 34 according to the embodiment. The fixing apparatus 34 shown in FIG. 2 is an apparatus of fixing system through electromagnetic induction heating (hereinafter also referred to as "IH"). The fixing system is not limited to IH system, and may also be a lamp heating system which comprises a heating lamp in the inner peripheral surface of a fixing belt 50.

As shown in FIG. 2 and FIG. 3, the fixing apparatus 34 comprises a belt (the fixing belt 50), a roller (a press roller 51), an IH coil unit 52 and a heating auxiliary plate 69. The fixing belt 50 is an endless belt having a cylinder shape. A belt internal mechanism 55 is arranged on the inner peripheral surface of the fixing belt 50. The belt internal mechanism 55 includes a nip pad 53, a frame 53*d*, a temperature sensor 64, a thermostat 65 and the heating auxiliary plate 69. Further, in the present embodiment, the fixing belt 50 contacts the heating auxiliary plate 69.

Figure 4:
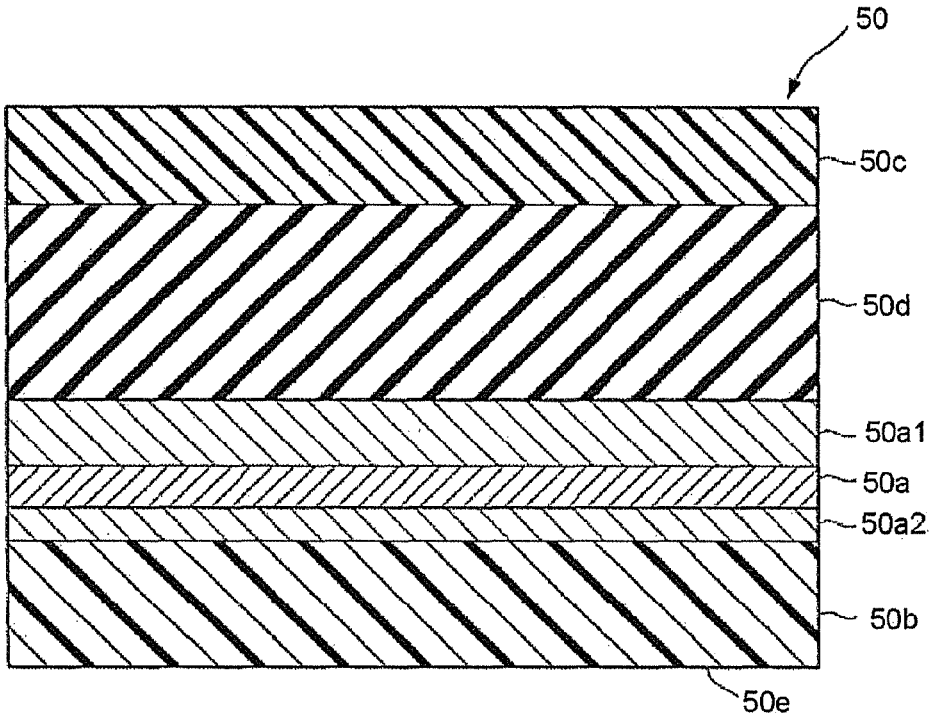
FIG. 4 is a cross-sectional view illustrating a fixing belt of the fixing apparatus according to the embodiment.

As shown in FIG. 4, a heating generation layer 50*a* (conductive layer) serving as a heating generation section, a cushion layer 50*d* and a release layer 50*c* are sequentially laminated on a base layer 50*b* arranged on the inner peripheral surface. The fixing belt 50 is formed by the laminated body described above. The base layer 50*b* constitutes an inner peripheral surface 50*e* of the fixing belt 50.

For example, the base layer 50*b* is made from polyimide resin (PI).

For example, the heating generation layer 50*a* is made of a non-magnetic metal such as copper (Cu).

For example, the cushion layer 50*d* is made of solid rubber such as the silicon rubber.

For example, the release layer 50*c* is made from fluoro resin such as tetrafluoroethylene and perfluo alkyl vinyl ether (PFA) copolymer resin.

To reduce the heat capacity of the fixing belt 50, the thickness of copper layer of the heating generation layer 50*a* is set to 10 μm. For example, the heating generation layer 50*a* is nipped by a nickel protective layer 50*a*1 and a nickel protective layer 50*a*2. The protective layers 50*a*1 and 50*a*2 cover the front and back surface of the heating generation layer 50*a* to suppress the oxidation of the copper layer. For example, the thickness of the base layer 50*b* is set to 70 μm. For example, the base layer 50*b* may be made of magnetic stainless steel (SUS) other than the polyimide resin.

In order to obtain rapid warming-up, the heating generation layer 50*a* is formed thinner to reduce the heat capacity of the fixing belt 50. For the fixing belt 50 having small heat capacity, the time required for warming-up is shortened and the consumption energy is saved.

Further, the protective layer 50*a*2 obtained by electro-less nickel plating may cover the base layer 50*b* that is made from the polyimide resin. Further, the protective layer 50*a*2 may be used as binder layer, and the heating generation layer 50*a* may be formed through electrolytic copper plating on the protective layer 50*a*2. The electro-less nickel plating processing is carried out, which improves the adhesion strength between the base layer 50*b* and the heating generation layer 50*a*. Further, a protective layer 50*a*1 obtained through electrolytic nickel plating processing may be further formed on the heating generation layer 50*a*.

Further, the surface of the base layer 50*b* may be roughened by sandblasting or chemical etching. In this way, the adhesion strength between the base layer 50*b* and the nickel plating layer of the heating generation layer 50*a* further improves mechanically.

The metal such as titanium (Ti) may be dispersed into the polyimide resin constituting the base layer 50*b*. By dispersing metal into the base layer 50*b*, the adhesion strength between the base layer 50*b* and the nickel plating layer of the heating generation layer 50*a* further improves.

For example, the heating generation layer 50*a* may be made by nickel, iron (Fe), stainless steel, aluminum (Al), or silver (Ag). The heating generation layer 50*a* may be formed by two kinds or more than two kinds of alloys, or laminating more than two kinds of metal in a layer shape.

As shown in FIG. 2, the IH coil unit 52 is equipped with a main coil 56. High frequency current is applied to the main coil 56. By making the high frequency current flow through the main coil 56, a high frequency magnetic field is generated around the main coil 56. An eddy current is generated in the heating generation layer 50*a* of the fixing belt 50 through the magnetic flux of the high frequency magnetic field. Joule heat is generated in the heating generation layer 50*a* by the eddy current and the electrical resistance of the heating generation layer 50*a*. The fixing belt 50 is heated through the generation of the joule heat.

The heating auxiliary plate 69 is arranged in the inner peripheral surface of the fixing belt 50. When seen from the belt width direction, the heating auxiliary plate 69 is formed in an arc shape along the inner peripheral surface of the fixing belt 50. The heating auxiliary plate 69 faces the main coil 56 across the fixing belt 50.

Figure 5:
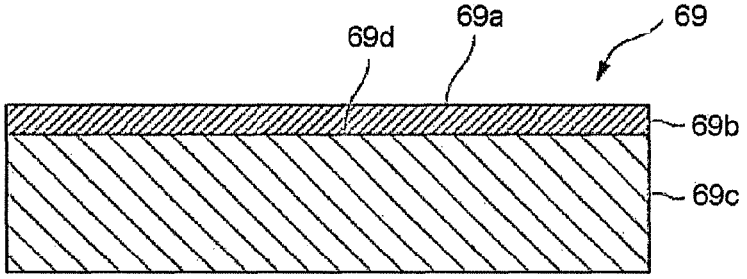
FIG. 5 is a cross-sectional view illustrating an auxiliary heating plate of the fixing apparatus according to the embodiment.

It is assumed that an auxiliary plate body 69*c* (magnetic material, refer to FIG. 5) of the heating auxiliary plate 69 is a magnetic shunt alloy (Ferromagnetic material) having a lower curie point than that of the heating generation layer 50*a*. Magnetic flux is generated between the main coil 56 and the fixing belt 50 through the magnetic flux generated by the main coil 56. Magnetic flux is also generated between the heating auxiliary plate 69 and the fixing belt 50 through the magnetic flux generated by the main coil 56. Through the generation of the aforementioned magnetic flux, the fixing belt 50 is heated.

A surface layer (non-magnetic layer 69*b*) contacting with the fixing belt 50 is formed on the outer peripheral side (the side of the fixing belt 50) of the auxiliary plate body 69*c*. The non-magnetic layer 69*b* does not contain magnetic material such as nickel (Ni). The non-magnetic layer 69*b* prevents the corrosion of the auxiliary plate body 69*c* serving as base material. Further, the heating of the heating generation layer 50*a* by the IH coil unit 52 does not have an influence on the non-magnetic layer 69*b*.

For example, if the surface layer of the heating auxiliary plate 69 contains nickel, the nickel makes the heating generation layer 50*a* generate too much heat. That is, the curie point of the nickel is higher than the curie point of the heating auxiliary plate 69 (magnetic shunt alloy). The curie point of the nickel is 627 degrees centigrade. Thus, after the temperature of the magnetic shunt alloy rises to the curie point and a magnetic path disappears, a magnetic path is formed between the nickel and the heating generation layer 50*a* (conductive layer). As a result, the nickel assists in generating heat. The thicker the nickel layer is, the more heat the nickel layer generates. If the rise of temperature of the fixing belt 50 continues, a measurement may be taken such as stopping the IH coil unit 52. As a result, the heating efficiency gets bad.

On the contrary, the non-magnetic layer 69*b* does not generate a magnetic path with the conductive layer. Thus, the non-magnetic layer 69*b* can hardly affect the heating of the conductive layer.

The heating auxiliary plate 69 is supported by a foundation (not shown) at two ends of the arc shape thereof. The outer side in the radial direction of the heating auxiliary plate 69 abuts on the inner peripheral surface of the fixing belt 50. The heating auxiliary plate 69 is supported by the belt internal mechanism 55 at the two ends of the arc shape thereof. The heating auxiliary plate 69 is supported in an elastic manner. The heating auxiliary plate 69 is pressed against the fixing belt 50. Thus, the heating auxiliary plate 69 has a constitution contacting with the inner side of the fixing belt 50.

Further, the heating auxiliary plate 69 may approach or separate from the fixing belt 50 through the belt internal mechanism 55. For example, the belt internal mechanism 55 may enable the outer side in the radial direction of the heating auxiliary plate 69 to separate from the inner peripheral surface of the fixing belt 50 at the time of warming-up of the fixing apparatus 34.

Further, the length in the belt width direction of the heating auxiliary plate 69 is longer than a length of a sheet-passing area (hereinafter referred to as a "sheet width") in the belt width direction. Further, the sheet width is larger than the width of a shortest side of a sheet among the used sheets. For example, it is assumed that the sheet width is slightly larger than the width of the short sides of the A3-sized paper.

As shown in FIG. 2, a shield 76 is arranged on the inner peripheral side of the heating auxiliary plate 69. The shield 76 is formed into an arc shape similar to the heating auxiliary plate 69. The shield 76 is supported by a foundation (not shown) at two ends of the arc shape. The shield 76 may support the heating auxiliary plate 69. For example, the shield 76 is made of non-magnetic material such as aluminum, copper and the like. The shield 76 shields the magnetic flux from the IH coil unit 52.

At the inner peripheral side of the fixing belt 50, the nip pad 53 presses the inner peripheral surface of the fixing belt 50 against the side of the press roller 51. A nip 54 is formed between the fixing belt 50 and the press roller 51. The nip pad 53 has a nip forming surface 53*a* where the nip 54 is formed between the fixing belt 50 and the press roller 51. When seen from the belt width direction, the nip forming surface 53*a* bends to form a convex shape at the inner peripheral side of the fixing belt 50. When seen from the belt width direction, the nip forming surface 53*a* bends to extend along the outer peripheral surface of the press roller 51.

For example, the nip pad 53 includes a pad main body 53*e* and a coating layer 53*b*.

The pad main body 53*e* is formed by elastic material such as silicon rubber, fluororubber and the like. The pad main body 53*e* may be formed by heat-resistant resin. As the heat-resistant resin, the PI (polyimide resin), the PPS (polyphenylene sulfide resin), the PES (polyether sulfone resin), the LCP (liquid crystal polymer), the PF (phenol resin) and the like are exemplified.

The coating layer 53*b* is formed on a surface facing the fixing belt 50 of the nip pad 53. This coating layer 53*b* reduces the friction between the nip pad 53 and the fixing belt 50. The coating layer 53*b* further has a function of enhancing the slid ability. With the function, it is possible to prevent the abrasion due to friction between the nip pad 53 and the fixing belt 50. The coating layer 53*b* further has a heat transfer function. Through this heat transfer function, the excessive heat generated in non-paper passing area is transferred to the paper-passing area in a case in which small-sized sheets are passed continuously. As a result, the temperature unevenness between the paper-passing area and the non-paper passing area is eliminated.

The aforementioned coating layer 53*b* is constituted by a simple substance or a compound including at least one element selected from the group 6 element and the group 14 element. As a concrete example of the group 6 element, chrome (Cr) or molybdenum (Mo) is exemplified. As a concrete example of the group 14 element, carbon (C) or tin (Sn) are exemplified. As a concrete example of a simple substance or a compound including at least one element selected from the group 6 element and the group 14 element, chromium nitride (CrN), chromium di-nitride ($Cr_2N$), molybdenum (Mo), tin (Sn), diamond-like carbon (DLC) and tri-acetyl cellulose (TAC) and the like are exemplified.

The thermal conductivity of the coating layer 53*b* is preferably more than 8 W/m·K, and more preferably, is more than 10 W/m·K. If the thermal conductivity is greater than the aforementioned lower limit value, the coating layer 53*b* can have a good heat transfer function. Further, the temperature unevenness between the paper-passing area and the non-paper passing area can be eliminated. Though the upper limit value of the thermal conductivity of the coating layer 53*b* is not limited specifically, it is set to about 1500 W/m·K substantially.

The friction coefficient of the surface of the coating layer 53*b* is preferably below 0.5, and more preferably, is below 0.4. If the friction coefficient is below the aforementioned upper limit value, the coating layer 53*b* can have a good slid ability. Further, it is possible to prevent the abrasion between the nip pad 53 and the fixing belt 50. Though the lower limit value of the friction coefficient of the surface of the coating layer 53*b* is not limited specifically, it is set to about 0.01 substantially.

The Vickers hardness of the coating layer 53*b* is preferably more than 500 HV, and more preferably, is more than 600 HV. Though the upper limit value of the Vickers hardness of the coating layer 53*b* is not limited specifically, it is set to about 4000 HV substantially.

No specific limitation is given to the coating thickness of the coating layer 53*b*, it may be properly determined according to the material of the coating layer 53*b*. The coating thickness of the coating layer 53*b* is preferably 0.5~20 μm, and more preferably, is 0.5~15 μm. If the coating layer 53*b* is a laminated type layer, the coating thickness of each single layer is preferably 0.5~10 μm, and more preferably, is 0.5~5 μm. If the coating thickness is below the aforementioned upper limit value, the heat transfer property of the coating layer 53*b* can be well maintained even when the fixing apparatus 34 is operated for a long time. If the coating thickness is above the aforementioned lower limit value, the protective function of the coating layer 53*b* can be well maintained even when the fixing apparatus 34 is operated for a long time.

No specific limitation is given to the manufacturing method of the coating layer 53*b*. For example, the coating layer 53*b* is manufactured through the plating processing or the coating processing. In a case of plating processing, the coating layer 53*b* is a plating layer. In this case, the coating layer 53*b* can be formed on the entire surface of the nip pad 53. For example, a spray coating is exemplified as the coating processing. In a case of the coating processing, the coating layer 53*b* is a coating film. In this case, the coating layer 53*b* can be formed on part or whole of the surface of the nip pad 53.

Other coating layer may be arranged between the coating layer 53*b* and the pad main body 53*e*. Other coating layer may be constituted by same/different materials as/from the coating layer 53*b*.

A thermal equalization member 53*c* is arranged at the inner peripheral side of the fixing belt 50. As shown in FIG. 2 and FIG. 3, the thermal equalization member 53*c* is connected with the nip pad 53. Further, the thermal equalization member 53*c* is arranged in parallel with the width direction of the fixing belt 50. The thermal equalization member 53*c* also abuts on the frame 53*d* that is in parallel to the nip pad 53. The frame 53*d* is arranged at the inner peripheral side of the fixing belt 50 to support the thermal equalization member 53*c*. The thermal equalization member 53*c* is surrounded by and fixed by the nip pad 53 and the frame 53*d*. The thermal equalization member 53*c* has a high heat transfer function. In a case in which the small-sized sheets are passed continuously, the thermal equalization member 53*c* not only absorbs the excessive heat in the non-paper passing area but also releases the excessive heat in the paper passing area. In this way, the temperature unevenness between the paper-passing area and the non-paper passing area is eliminated.

Further, a heat storage material may be arranged inside the frame 53*d*.

As a concrete example of the thermal equalization member 53*c*, a heat pipe is exemplified. Further, a heat conductive member which is formed by at least one of aluminum and copper is exemplified as other concrete example of the thermal equalization member 53*c*. When the thermal equalization member 53*c* is the heat pipe or the thermal conductive member which is formed by at least one of aluminum and copper, the heat equalization property of the fixing belt 50 is improved.

Further, the fixing apparatus 34 may be not provided with the thermal equalization member 53*c*. From the point of view of improving the heat equalization property of the fixing belt 50, it is preferable that the fixing apparatus 34 is provided with the thermal equalization member 53*c*.

In a case in which the thermal equalization member 53*c* is arranged at the inner peripheral side of the fixing belt 50, it is preferable that the coating layer 53*b* is formed on the entire surface of the nip pad 53. That is, it is preferable that the coating layer 53*b* is formed on the entire surface of the nip pad 53, including the surface where the thermal equalization member 53*c* abuts on the nip pad 53. With such a constitution, the heat of the fixing belt 50 is transferred to the thermal equalization member 53*c* via the coating layer 53*b*. Since the nip pad 53 does not transfer heat, the heat equalization property of the fixing belt is further improved.

The operations of the fixing apparatus 34 are described.

When the fixing apparatus 34 is warming up, the fixing apparatus 34 rotates the fixing belt 50 in a direction indicated by an arrow u as shown in FIG. 2. By being applied with high frequency current, the IH coil unit 52 generates magnetic flux at the side of the fixing 50.

Further, at the time of warming up, the press roller 51 may be rotated in a direction indicated by an arrow q in a state in which the press roller 51 abuts against the fixing belt 50. Through this operation, the fixing belt 50 is driven to rotate in the direction indicated by the arrow u.

When the magnetic flux is generated in the fixing belt 50, the fixing belt 50 is heated.

After the temperature of the fixing belt 50 rises to the fixing temperature and the warming-up operation is ended, the press roller 51 abuts on the fixing belt 50. In the state in which the press roller 51 abuts on the fixing belt 50, the press roller 51 is rotated in a direction indicated by the arrow q. Through this operation, the fixing belt 50 is driven to rotate in a direction indicated by the arrow u. If there is a print request, the MFP 10 (refer to FIG. 1) starts print operations. The MFP 10 forms a toner image on the sheet P with the printer section 18, and conveys the sheet P to the fixing apparatus 34.

The MFP 10 enables the sheet P on which the toner image is formed to pass through the nip 54 between the press roller 51 and the fixing belt 50 of which the temperature rises to the fixing temperature. The fixing apparatus 34 fixes the toner image on the sheet P.

When the sheet P passes through the nip 54, the fixing belt 50 moves in a state of being pressurized by both the nip pad 53 and the press roller 51 in the nip 54. At this time, since the coating layer 53*b* is formed on the nip pad 53, the nip pad 53 and the fixing belt 50 can hardly abraded due to friction therebetween. Further, even if the small-sized sheets are passed continuously, the temperature unevenness between the paper-passing area and the non-paper passing area is eliminated.

In accordance with the image forming apparatus of the embodiment, a coating layer which is excellent in slid ability and heat transfer function is formed on a surface facing a fixing belt of a nip pad in a fixing apparatus. Further, the coating layer is constituted by a simple substance or a compound including at least one element selected from a group 6 element and a group 14 element. Thus, it is possible to prevent the abrasion due to the friction between the nip pad and the fixing belt. Further, even if the small-sized sheets are passed continuously, the temperature unevenness between the paper-passing area and the non-paper passing area is eliminated. As a result, the durability of the fixing belt is improved, and the long-life of the image forming apparatus can be achieved.

EXAMPLES

Hereinafter, the embodiment is further described in detail with reference to the following example.

In the example, the image forming apparatus shown in FIG. 1 which comprises the fixing apparatus shown in FIG. 2 carries out continuous paper-passing operations. The sheet used for continuous paper-passing is paper. The continuous paper-passing speed is 225 "m/s". The continuous paper-passing time is 2 minutes. The number of paper-passing sheets is 200. The material, coating thickness, hardness, thermal conductivity, friction coefficient and heat-resistant temperature of the coating layers in examples 1~6 and comparative examples 1~4 are shown in table 1. Further, the evaluation on the fixing belt after continuous paper-passing and a temperature difference between the paper-passing area and non-paper passing area of the fixing belt are shown in the table 1.

In the example, the central part of the fixing belt is measured as the paper-passing area. Further, a position 140 mm away from the central part of the fixing belt is measured as the non-paper passing area.

TABLE 1

| | MATERIAL OF COATING LAYER | THICKNESS OF COATING LAYER [μm] | HARDNESS OF COATING LAYER | THERMAL CONDUCTIVITY OF COATING LAYER [(W/m · K)] | FRICTION COEFFICIENT OF COATING LAYER | HEAT RESISTANCE TEMPERATURE OF COATING LAYER | EVALUATION OF FIXING BELT AFTER PASSING SHEETS CONTINUOUSLY | DIFFERENCE BETWEEN TEMPERATURES OF PAPER PASSING AREA AND NON-PAPER PASSING AREA [° C.] |
|---|---|---|---|---|---|---|---|---|
| EXAMPLE 1 | CHROMIUM NITRIDE | 0.5 | 1000-2000 HV | 9 | 0.5 | 700 | NO DETERIORATION | 13.0 |
| EXAMPLE 2 | CHROMIUM NITRIDE | 0.5 | 1000-2000 HV | 21 | 0.5 | 1650 | NO DETERIORATION | 13.0 |
| EXAMPLE 3 | PTFE + MOLYBDENUM *1 | 10 | 6H (HARDNESS OF PENCIL) | 0.23 | 0.14 | 260 | NO DETERIORATION | 11.6 |
| EXAMPLE 4 | Ni AND Sn *2 | Ni LAYER: Sn LAYER: 0.5 | 700 HV | 64 | 0.29 | 300 | NO DETERIORATION | 14.2 |
| EXAMPLE 5 | DLC | 0.5-2 | 1500 HV | 20-300 | 0.14 | 600 | NO DETERIORATION | 13.8 |
| EXAMPLE 6 | TAC | 0.5 | 4000 HV | 1000 | 0.1 | 800 | NO DETERIORATION | 14.9 |
| COMPARATIVE EXAMPLE 1 | ELECTROLESS Ni—P | 3-5 | 500 HV | 90.9 | 0.7 | 300 | THERE IS DETERIORATION AND FIXING BELT IS DAMAGED | 20.0 |
| COMPARATIVE EXAMPLE 2 | ELECTROLESS Ni—P (HEAT AT TEMPERATURE OF 400 DEGREES CENTIGRADE FOR AN HOUR) | 3-5 | 900 HV | 90.9 | 0.7 | 890 | THERE IS DETERIORATION AND FIXING BELT IS DAMAGED | 19.2 |

TABLE 1-continued

| | MATERIAL OF COATING LAYER | THICKNESS OF COATING LAYER [μm] | HARDNESS OF COATING LAYER | THERMAL CONDUCTIVITY OF COATING LAYER [(W/m · K)] | FRICTION COEFFICIENT OF COATING LAYER | HEAT RESISTANCE TEMPERATURE OF COATING LAYER | EVALUATION OF FIXING BELT AFTER PASSING SHEETS CONTINUOUSLY | DIFFERENCE BETWEEN TEMPERATURES OF PAPER PASSING AREA AND NON-PAPER PASSING AREA [° C.] |
|---|---|---|---|---|---|---|---|---|
| COMPARATIVE EXAMPLE 3 | ELECTROLESS Ni—P + PTFE | 3-5 | AT THE TIME OF SEPARATIONP 300 HV AFTER HEATING PROCESSING 550 HV | 90.9 | 0.09 (AFTER HEATING PROCESSING) | 260 | THERE IS DETERIORATION AND FIXING BELT IS DAMAGED | 18.5 |
| COMPARATIVE EXAMPLE 4 | ELECTROLESS Ni—P + BORON | 2-4 | 800 | 90.9 | 0.5 | 650 | NO DETERIORATION | 18.4 |

PTFE: Polytetrafluoroethylene, DLC: Diamond Like Carbon, TAC: Triacetylcellulose

*1 The lubrication film "dry coat 3500" manufactured by mitech lubricant co., ltd is used.

*2 Ni layer and Sn layer are laminated on the nip pad sequentially.

In the examples 1~6, it is confirmed that there is no deterioration such as damage on the fixing belt after the continuous paper-passing. Further, it is aware that the temperature unevenness is small when the temperature difference between the paper-passing area and the non-paper passing area is in a range of 0~15 degrees centigrade, and specifically, is in a range of 0~14.9 degrees centigrade.

On the other hand, in the comparative examples 1~4, it is confirmed that there is deterioration such as damage on the fixing belt after the continuous paper-passing. Further, it is aware that the temperature unevenness is large when the temperature difference between the paper-passing area and the non-paper passing area is higher than 15 degrees centigrade, and specifically, is higher than 18.4 degrees centigrade.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus which comprises a fixing apparatus configured to fix a toner image formed on an image receiving medium, wherein the fixing apparatus comprises an endless member;

a pressing member which faces a roller across the endless member and pressurizes the endless member together with the roller, the pressing member arranged at an inner peripheral side of the endless member, the pressing member presses the endless member, and the pressing member includes a pad main body and a coating layer;

a thermal equalization member in contact with the pressing member is arranged; and the coating layer is formed on a surface of the pressing member which faces the endless member, and the coating layer is constituted by a simple substance or a compound having at least one kind of elements selected from a group 6 element and a group 14 element from a Periodic Table of the Elements, wherein the coating layer is formed on the entire surface of the pressing member including a surface in contact with the thermal equalization member.

2. The image forming apparatus according to claim 1, wherein a thermal conductivity of the coating layer is greater than 8 W/m·K.

3. The image forming apparatus according to claim 1, wherein a friction coefficient of the surface of the coating layer is lower than 0.5.

4. The image forming apparatus according to claim 1, wherein a Vickers hardness of the coating layer is greater than 500 HV.

5. The image forming apparatus according to claim 1, wherein the coating layer is constituted by at least a simple substance or a compound selected from chromium nitride, chromium di-nitride, molybdenum, tin, diamond-like carbon and tri-acetyl cellulose.

6. The image forming apparatus according to claim 1, wherein the coating layer is selected from a group consisting of: a plating layer, a spray coating, or a coating film.

7. The image forming apparatus according to claim 1, wherein the thermal equalization member is a heat pipe.

8. The image forming apparatus according to claim 1, wherein the thermal equalization member is a heat conduction member formed by at least one of aluminum and copper.

9. The image forming apparatus according to claim 1, wherein the coating layer is constituted by tin or a compound of tin.

* * * * *